US010190183B2

(12) United States Patent
Herwig

(10) Patent No.: US 10,190,183 B2
(45) Date of Patent: Jan. 29, 2019

(54) METHOD FOR DESULFURIZING

(71) Applicant: Frank Herwig, Gröditz (DE)

(72) Inventor: Frank Herwig, Gröditz (DE)

(73) Assignee: Almamet GmbH, Ainring (DE)

( * ) Notice: Subject to any disclaimer, the term of this patent is extended or adjusted under 35 U.S.C. 154(b) by 0 days.

(21) Appl. No.: 15/492,484

(22) Filed: Apr. 20, 2017

(65) Prior Publication Data

US 2017/0218469 A1 Aug. 3, 2017

Related U.S. Application Data

(62) Division of application No. 14/351,916, filed on Apr. 15, 2014, now abandoned.

(30) Foreign Application Priority Data

Oct. 20, 2011 (DE) ..... 10 2011 116 501

(51) Int. Cl.

| | |
|---|---|
| ***C21B 3/02*** | (2006.01) |
| ***C21C 1/02*** | (2006.01) |
| ***C21C 7/064*** | (2006.01) |
| ***C21C 7/00*** | (2006.01) |

(52) U.S. Cl.

CPC ..... *C21C 1/025* (2013.01); *C21B 3/02* (2013.01); *C21C 1/02* (2013.01); *C21C 7/0037* (2013.01); *C21C 7/0087* (2013.01); *C21C 7/064* (2013.01); *C21C 7/0645* (2013.01); *C21C 2007/0062* (2013.01); *C21C 2250/00* (2013.01)

(58) Field of Classification Search

CPC .. C21B 3/02; C21C 1/025; C21C 1/02; C21C 7/064; C21C 7/0645; C21C 7/0087

See application file for complete search history.

(56) References Cited

U.S. PATENT DOCUMENTS

| | | | | |
|---|---|---|---|---|
| 4,225,343 A | | 9/1980 | Guarino et al. | |
| 4,592,777 A | | 6/1986 | Rellermeyer | |
| 5,284,504 A | * | 2/1994 | Barker | C21C 1/025 75/312 |
| 6,395,205 B1 | | 5/2002 | Huege | |
| 2006/0260508 A1 | * | 11/2006 | Bailey | C08L 95/00 106/123.11 |
| 2011/0233105 A1 | | 9/2011 | Bailey | |

FOREIGN PATENT DOCUMENTS

| | | | | | |
|---|---|---|---|---|---|
| AT | 22 578 | E | | 1/1987 | |
| AT | 412 477 | | | 3/2005 | |
| CA | 2829030 | A1 | | 7/2012 | |
| CN | 1528919 | A | | 9/2004 | |
| DE | 22 43 862 | | | 3/1974 | |
| DE | 22 52 796 | C3 | | 8/1982 | |
| DE | 195 02 302 | C2 | | 12/1996 | |
| DE | 198 57 733 | A1 | | 6/2000 | |
| DE | 10 2008 014 893 | A1 | | 9/2009 | |
| DE | 10 2011 008 690 | A1 | | 7/2012 | |
| DE | 10 2011 008 691 | A1 | | 7/2012 | |
| DE | 102011008691 | A1 | * | 7/2012 | C21C 1/025 |
| EP | 0 164 592 | | | 5/1985 | |
| EP | 0 226 994 | | | 12/1986 | |
| EP | 0 398 674 | B1 | | 3/1996 | |
| GB | 1373941 | A | | 11/1974 | |
| JP | 48-66012 | | | 9/1973 | |
| JP | 49-40299 | | | 4/1974 | |
| JP | 61-157605 | | | 7/1986 | |
| JP | 61179810 | A | * | 8/1986 | C21C 7/0006 |
| JP | 7-188728 | | | 7/1995 | |
| JP | 2009040827 | | | 2/2009 | |
| KR | 10-2004-0052583 | | | 6/2004 | |
| RO | 118137 | B | * | 2/2003 | |
| SU | 336300 | A | | 5/1972 | |
| WO | 2012/095471 | A2 | | 7/2012 | |

OTHER PUBLICATIONS

DE-102011008691-A1 machine translation of the description. (Year: 2012).*

JP-61179810-A machine translation of the description. (Year: 1986).*

* cited by examiner

*Primary Examiner* — George Wyszomierski
*Assistant Examiner* — Tima M McGuthry-Banks
(74) *Attorney, Agent, or Firm* — Francis C. Hand; Carella, Byrne, et al.

(57) ABSTRACT

The method employs a desulfurization agent that is introduced into a smelt of one of molten pig iron and molten steel. The desulfurization agent contains calcium oxide, bitumen and at least one flux agent, with the agent containing 1 to 10% by weight bitumen.

12 Claims, No Drawings

METHOD FOR DESULFURIZING

This is a Division of application Ser. No. 14/351,916, filed Apr. 15, 2014, now abandoned.

The present invention relates to a method of desulfurizing in particular for desulfurizing and/or pre-desulfurizing molten pig iron or molten steel and to a method of manufacturing an agent for desulfurizing and/or pre-desulfurizing molten pig iron or molten steel.

A mixture of iron ore and coke which acts both as an energy carrier and as a reductant for the iron ore is typically reduced to pig iron in a furnace for manufacturing pig iron. Due to the comparatively high sulfur content of coke, comparatively high sulfur quantities are introduced into the molten pig iron in this method. Since a high sulfur content negatively impairs the mechanical properties both of cast iron manufactured from the pig iron and of steel manufactured from the pig iron, the sulfur introduced in the pig iron extraction has to be removed from the pig again and/or from the steel manufactured therefrom again to set the desired sulfur content.

A plurality of desulfurization agents have been proposed to remove sulfur from pig iron and/or from steel which are, for example, introduced pneumatically or mechanically into the molten pig iron or molten steel and reduce the sulfur there to a sulfur compound such as calcium sulfide which rises in the molten pig iron and thus passes into the slag with which it is later removed from the pig iron. Magnesium, magnesium alloys, soda, burnt lime, and calcium carbide are, for example, known as reductants for desulfurization. It is additionally known to add a further compound to such reductants to increase their efficiency in the desulfurizing of pig iron and/or steel. A desulfurizing agent is thus disclosed in DE 22 52 796 C3 which contains a solid compound containing hydrogen such as polyethylene or polyamide as a reductant in addition to calcium chloride or calcium cyanamide. Furthermore, a desulfurization agent is known from EP 0 226 994 B1 which contains calcium carbide and dried coal.

A number of the above-named desulfurization agents, however, have properties disadvantageous for pig iron desulfurization. For example, soda decomposes explosively on the introduction into the pig iron, which results in increased wear of the involved components. In addition, the degrees of desulfurization which can be achieved with soda are unsatisfactorily low. Furthermore, soda reacts exothermally with sulfur so that temperature losses occur in the pig iron. The degrees of desulfurization achievable with magnesium and magnesium alloys as the desulfurization agent are also limited, and indeed inter glia due to the fact that the solubility of magnesium increases as the temperature of the pig iron increases and the sulfur content drops. The above-named calcium compounds such as polyethylene, polyamide and dried coal, added to calcium carbide to increase the degree of desulfurization also have disadvantages. The addition of plastics such as polyethylene or polyamide to the calcium carbide degrades the injection behavior of the desulfurization agent into the molten pig iron. Furthermore dried coals are prone to self-ignition in air. In addition, they have to be admixed with the calcium carbide—due to the high reactivity of calcium carbide with water—with a sufficiently low moisture content so that such coals are expensive and require an increased effort with respect to storage and transport.

For this reason, primarily desulfurization agents based on calcium compounds such as calcium carbide, calcium oxide, calcium hydroxide or calcium carbonate are used for desulfurizing molten pig iron and/or molten steel. Of these, calcium carbide has the highest specific efficiency in desulfurization, i.e. a desulfurization of molten pig iron higher by approximately a factor of 2 is achieved with a predefined quantity of calcium oxide than with the same quantity of calcium oxide. Calcium carbide reacts with water while forming acetylene which, like all low molecular hydrocarbons forms easily flammable mixtures with air. For this reason, the transport and the storage of calcium carbide are complex and cost-intensive. Against this background, an agent for desulfurizing molten pig iron or molten steel based on calcium oxide with a high desulfurization efficiency would be desirable.

It is therefore the object of the present invention to provide a desulfurization agent based on calcium oxide which has a high specific efficiency in the desulfurizing of molten pig iron or molten steel.

This object is satisfied in accordance with the invention by an agent for desulfurizing and/or pre-desulfurizing, in particular for desulfurizing or pre-desulfurizing molten pig iron or molten steel, which contains calcium oxide and bitumen.

This solution is based on the surprising recognition that the admixture of bitumen to calcium oxide significantly reduces the efficiency of calcium oxide in the desulfurization and/or pre-desulfurization of molten pig iron or molten steel—in comparison with the same mixture without a bitumen admixture—and indeed in dependence on the respective different works-specific physical, chemical and technological conditions up to the desulfurization power of calcium carbide. In this respect, it is of particular advantage that the admixed bitumen does not impair, or at least does not significantly impair, the injection behavior of the desulfurization agent into the molten pig iron. Apart from this, bitumen is stable in air, is not auto-ignitable and is not reactive with water so that bitumen is not subject to any transport restrictions or storage restrictions. Overall, the desulfurization agent thus has the advantages of calcium oxide while simultaneously avoiding the disadvantages of the desulfurization agent known from the prior art.

Bitumen is a mixture of high molecular weight hydrocarbons which both occurs naturally and can also be manufactured, for example, by vacuum distillation from crude oil. In this respect, bitumen is the crude oil fraction with the highest boiling point and the non-boiling crude oil fraction which are not modified in vacuum distillation. Bitumen is a dispersion in which high-carbon particles, the so-called asphaltenes, as well as resins in an oily base mass, whose components are called maltenes, are present in colloidally dissolved form. The maltenes are primarily aromatic hydrocarbons, cycloalkanes, alkanes and alkenes having a molecular weight meaned over the weight of 500 to 1,500 g/mol in each case, whereas the asphaltenes comprise aromatic hydrocarbons and heterocyclic compounds having a comparatively high molecular weight.

Bitumen is understood in the sense of the present invention as all of the corresponding compositions defined in DIN EN 12597, that is in particular also asphalts—all mixtures of bitumen and aggregates—as well as all fractions which have been obtained from bitumen and/or asphalt by any desired separation technique.

Within the framework of the present invention, all naturally occurring bitumens and all bitumen manufactured synthetically, for example from crude oil, can be used as the bitumen, and indeed independently of whether they are present in solid form, paste-like form or liquid form. Those can be named in this connection, for example, which are selected from the group which consists of road construction bitumen, hard road construction bitumen, soft bitumen, modified bitumen, distillation bitumen, high-vacuum bitumen, polymer-modified bitumen, special bitumen, industrial bitumen, oxidation bitumen, hard bitumen, blended bitumen, cold bitumen, fluxed bitumen, flux bitumen, natural asphalt and any desired mixtures of two or more of the aforesaid compounds, wherein the individual terms arc in turn meant in the meaning specified in DIN EN 12597.

The present invention is generally not restricted with respect to the quantity of bitumen contained in the desulfurization agent. For example, the desulfurization agent in accordance with the invention can contain 0.1 to 20% by weight of bitumen. The quantity of bitumen contained in the desulfurization agent, however, preferably amounts to 1 to 10% by weight, particularly preferably to 2 to 6% by weight, and very particularly preferably to 2 to 4% by weight.

As presented above, the calcium oxide contained in the desulfurization agent in accordance with the invention acts as a reductant for the sulfur contained in the molten pig iron or molten steel. In general, in addition to the calcium oxide, the desulfurization agent can contain other reductants, in particular based on another calcium compound. In the last-named embodiment, the desulfurization agent contains a mixture of two or more calcium compounds, with this mixture, which is also called a calcium component, preferably containing at least 20% by weight of calcium oxide and the remainder to 100% by weight being one or more compounds selected from the group consisting of calcium hydroxide, calcium carbonate, calcium carbide, and any desired mixtures of two or more of the aforesaid compounds. It is preferred due to the classification of calcium carbide as a hazardous material and to the transport and storage restrictions accompanying it that the quantity of calcium carbide contained in the desulfurization agent is as low as possible or that the desulfurization agent particularly preferably does not contain any calcium carbide at all, that is the desulfurization agent contains a mixture of two or more calcium compounds, with this mixture containing at least 20% by weight of calcium oxide and the remainder to 100% by weight being calcium hydroxide and/or calcium carbonate.

It is proposed in a further development of the idea of the invention that the calcium component or the mixture of calcium compounds of the desulfurization agent in accordance with the invention comprises at least 50% by weight of calcium oxide, preferably at least 75% by weight of calcium oxide, in particular preferably at least 90% by weight of calcium oxide, particularly preferably at least 95% by weight of calcium oxide, and very particularly preferably at least 99% by weight of calcium oxide.

In accordance with a very particularly preferred embodiment of the present invention, the desulfurization agent contains calcium oxide as the only calcium compound.

A calcium oxide manufactured in all manners, such as soft burnt lime, medium burnt lime and hard burnt lime, can be used as the calcium oxide, with good results in particular being achieved with soft burnt lime.

In principle, the present invention is not restricted with respect to the quantity of the calcium oxide in the desulfurization agent in accordance with the invention. Good results are, however, in particular obtained when the desulfurization agent contains 80 to 99.9% by weight of calcium oxide, preferably 84 to 98% by weight of calcium oxide, particularly preferably 90 to 97% by weight of calcium oxide, and very particularly preferably 94 to 96% by weight of calcium oxide or a mixture thereof which contains at least 20% by weight of calcium oxide, preferably at least 50% by weight of calcium oxide, in particular preferably at least 75% by weight of calcium oxide, particularly preferably at least 90% by weight of calcium oxide, particularly preferably at least 95% by weight of calcium oxide, and most preferably at least 99% by weight of calcium oxide and the remainder to 100% being one or more compounds selected from the group consisting of calcium hydroxide, calcium carbonate, calcium carbide and any desired mixtures of two or more of the aforesaid compounds.

In accordance with an embodiment of the present invention, the desulfurization agent, in particular when it is designed for coinjection, preferably does not contain any other compound conventionally used for the reduction of sulfur such as in particular no magnesium, no magnesium alloy and no soda.

Provided that the desulfurization agent is to be introduced into the smelt to be treated by monoinfection, it can, however, in an alternative embodiment contain magnesium and/or a magnesium alloy such as in particular a magnesium aluminum alloy. It is preferred in this embodiment that the desulfurization agent contains 1 to 15% by weight, and preferably 6 to 12% by weight, of magnesium and/or of a magnesium alloy, preferably of a magnesium aluminum alloy.

Good results are in particular obtained in the above embodiment when the magnesium and/or magnesium alloy, preferably a magnesium aluminum alloy, contained in the desulfurization agent is particulate and when at least 99% of all particles have a diameter of at least 30 .mu.m, preferably of 30 to 200 .mu.m, and particularly preferably of 50 to 200 .mu.m. The desulfurization agent in this embodiment consequently particularly preferably contains 1 to 15% by weight, and very particularly preferably 6 to 12% by weight, of magnesium and/or of a magnesium alloy, having a previously described grain size.

In addition to the bitumen and the calcium oxide, and optionally magnesium and/or a magnesium alloy, the desulfurization agent in accordance with the invention preferably contains a flux agent to increase the flow behavior of the calcium oxide which has little flowability per se. All compounds known to the skilled person for this purpose can be used as the flux agent, with good results in particular being obtained with multivalent alcohols and silicone oils. Additionally or alternatively to this, bituminous coals can also be used as the flux agent. Examples for suitable multivalent alcohols are in particular glycols, whereas examples for particularly suitable silicone oils are organopolysiloxanes such as in particular polymethylhydrogensiloxanes.

The desulfurization agent in accordance with the invention preferably contains between 0.01 and 10% by weight, and particularly preferably between 0.05 and 5% by weight of one or more flux agents. The desulfurization agent in accordance with the invention in particular preferably contains between 0.05 and 0.5% by weight, further preferably between 0.05 and 0.2% by weight of one or more flux agents, very particularly preferably between 0.075 and 0.125% by weight of one or more flux agents, and most preferably approximately 0.1% by weight of one or more flux agents. Provided bituminous coal is contained as the flux agent, the amount of bituminous coal preferably amounts to 4 to 8% by weight with respect to the total weight of the desulfurization agent.

Apart from the bitumen, the calcium oxide, the optional magnesium or the optional magnesium alloy and the optional, but preferred flux agent, the desulfurization agent in accordance with the invention can contain one or more additives. The desulfurization agent preferably contains at least one additive which is selected from the group which consists of cryolite, sodium borate, fluorite and any desired mixtures of two or more of the above compounds.

The amount of additives contained in the desulfurization agent preferably amounts to 0.5 to 8% by weight, particularly preferably to 0.5 to 4% by weight, and very particularly preferably to 0.5 to 2% by weight.

In accordance with a particularly preferred embodiment of the present invention, the desulfurization agent is composed of or comprises:

i) 0.1 to 20% by weight bitumen, preferably 1 to 10% by weight bitumen, particularly preferably 2 to 6% by weight bitumen, and very particularly preferably 2 to 4% by weight bitumen;

ii) 0.01 to 10% by weight of a flux agent, preferably 0.05 to 0.5% by weight of a flux agent, particularly preferably 0.05 to 0.2% by weight of a flux agent, very particularly preferably 0.075 to 0.125% by weight of a flux agent, and most preferably approximately 0.1% by weight of a flux agent, said flux agent being selected from the group consisting of multivalent alcohols, bituminous coal and silicone oils and any desired mixtures thereof, preferably being selected from the group consisting of glycols, organopolysiloxanes, and any desired mixtures thereof, and particularly preferably of a polymethylhydrogensiloxane;

iii) 0 to 15% by weight of magnesium and/or of a magnesium alloy, preferably of a magnesium aluminum alloy, preferably 1 to 15% by weight of magnesium and/or of a magnesium alloy, preferably of a magnesium aluminum alloy, and particularly preferably 6 to 12% by weight of magnesium and/or of a magnesium alloy, preferably of a magnesium aluminum alloy;

iv) 0 to 10% by weight of an additive, preferably 0.5 to 8% by weight of an additive, particularly preferably 0.5 to 4% by weight of an additive, and particularly preferably 0.5 to 2% by weight of an additive, said additive being selected from the group consisting of cryolite, sodium borate, fluorite, and any desired mixtures of two or more of the above compounds; and v) remainder to 100% by weight being calcium oxide or a mixture which contains at least 20% by weight of calcium oxide, preferably at least 50% by weight of calcium oxide, in particular preferably 75% by weight of calcium oxide, particularly preferably at least 90% by weight of calcium oxide, very particularly preferably at least 95% by weight of calcium oxide, and most preferably 99% by weight of calcium oxide, and the remainder to 100% being one or more compounds selected from the group consisting of calcium hydroxide, calcium carbonate, calcium carbide, and any desired mixtures of two or more of the aforesaid compounds.

In accordance with a particularly preferred embodiment of the present invention, the desulfurization agent is composed of or comprises:

i) 2 to 4% by weight bitumen;

ii) 0.05 to 0.2% by weight of a flux agent selected from the group consisting of glycols, polymethylhydrogensiloxanes and any desired mixtures thereof;

iii) 0 to 15% by weight of magnesium and/or of a magnesium alloy, and preferably 6 to 12% by weight of magnesium and/or of a magnesium alloy;

iv) 0.5 to 2% by weight of an additive selected from the group consisting of cryolite, sodium borate, fluorite, and any desired mixtures of two or more of the above compounds; and v) the remainder to 100% being calcium oxide.

In accordance with a very particularly preferred embodiment of the present invention alternative to this, the desulfurization agent comprises or consists of:

i) 2 to 3% by weight of bitumen;

ii) 4 to 5% by weight of a flux agent selected from the group consisting of glycols, bituminous coals and any desired mixtures thereof;

iii) 0 to 15% by weight of magnesium and/or of a magnesium alloy, and preferably 6 to 12% by weight of magnesium and/or of a magnesium alloy;

iv) 0.5 to 2% by weight of an additive selected from the group consisting of cryolite, sodium borate, fluorite, and any desired mixtures of two or more of the above compounds; and iv) remainder to 100% being calcium oxide.

The desulfurization agent preferably has a flowability of at least 40 cm, preferably of at least 45 cm, particularly preferably of at least 55 cm, very particularly preferably of at least 60 cm, and most preferably of at least 65 cm. In this respect, the flowability is determined in an air conveying channel as follows: A pneumatic conveying channel is used which comprises an air box having a gas-permeable fabric, wherein the fabric has a width of 0.1 m and a length of 1.5 m and the fabric is aerated by a fan with a defined volume flow of 20 $m^3$/h air from below. A fabric is used having a specific fabric load of 1.6 $m^3/(min*m^2)$, wherein the specific fabric load is understood as the air quantity in $m^3$ per minute and per $m^2$ fabric area. The inclination of the conveying channel is set to 2°. A sample having a weight of 300 g is then weighed and is placed at the upper end of the air conveying channel and the outflow length in cm is determined, with the outflow length to be understood as the path length of the material conveyed by the air flow. In this respect, the measurement takes place in the middle of the conveying channel. The conveying channel is then cleaned using an industrial vacuum cleaner and the procedure is repeated successively with four further samples having a weight of 300 g respectively. The respective largest value and the respective smallest value of the values obtained for the outflow length are eliminated and the arithmetic mean of the remaining three values is formed. This arithmetic mean is the flowability.

In a further development of the idea of the invention, it is proposed that the desulfurization agent in accordance with the invention is present in the form of a mixture, and indeed preferably in the form of a homogeneous mixture.

In this respect, at least the calcium oxide contained in the desulfurization agent in accordance with the invention has such a distribution of a range of grain sizes that at least 80% by weight of the calcium oxide has a grain size of less than 32 μm, at least 85% by weight of the calcium oxide has a grain size of less than 45 μm, at least 90% by weight of the calcium oxide has a grain size of less than 63 μm, and at least 95% by weight of the calcium oxide has a grain size of less than 90 μm.

All the components of the desulfurization agent, with the exception of the magnesium and/or of the magnesium alloy optionally contained therein, preferably have an above distribution of a range of grain sizes, that is on in which at least 80% by weight of the components has a grain size of less than 32 μm, at least 85% by weight of the components has a grain size of less than 45 μm, at least 90% by weight of the components has a grain size of less than 63 μm, and at least 95% by weight of the components has a grain size of less than 90 μm.

It is furthermore also possible that all the components of the desulfurization agent have such a distribution of a range of grain sizes, i.e. that at least 80% by weight of the desulfurization agent has a grain size of less than 32 μm, at least 85% by weight of the desulfurization agent has a grain size of less than 45 μm, at least 90% by weight of the desulfurization agent has a grain size of less than 63 μm, and at least 95% by weight of the desulfurization agent has a grain size of less than 90 μm.

In accordance with a further particularly preferred embodiment of the present invention, the desulfurization agent has the form of one or more briquettes and preferably of one or more cushion-shaped briquettes. The briquette or briquettes preferably has/have a size (length×width) viewed in cross-section of 10×5 to 200×100 mm, preferably of 25×15 mm to 75×50 mm, and particularly preferably of 40×20 to 50×30 mm, such as of 45×25 mm. Such a briquette-shaped desulfurization agent is surprisingly characterized by a particularly high desulfurization effect for molten pig iron. In addition, such a briquette-shaped desulfurization agent surprisingly considerably reduces the total oxygen content of slag so that it is in particular also suitable for the slag treatment and desulfurization of pig iron.

The briquette-shaped desulfurization agent preferably contains bitumen, calcium oxide, optionally a further calcium compound and optionally one or more additives, with the above compounds preferably being selected from the above-named groups and being contained in the above-described quantities.

In accordance with a particularly preferred embodiment of the present invention, the briquette-shaped desulfurization agent consists of bitumen, calcium oxide, optionally one or more further calcium compounds and optionally one or more additives, with the above compounds preferably being selected from the above-named groups and being contained in the above-described quantities, i.e. the desulfurization agent in accordance with this embodiment does not contain any further components except for the above-named components and in particular contains no flux agent and also no magnesium or no magnesium alloy. The briquette-shaped desulfurization agent in accordance with this embodiment is in particular suitable for slag treatment.

In a further development of the idea of the invention, it is proposed that the briquette-shaped desulfurization agent is composed of:

i) 0.1 to 20% by weight of bitumen, preferably 1 to 10% by weight of bitumen, particularly preferably 2 to 6% by weight of bitumen, and very particularly preferably 2 to 4% by weight of bitumen;

ii) 0 to 10% by weight of an additive, preferably 0.5 to 8% by weight of an additive, particularly preferably 0.5 to 4% by weight of an additive and particularly preferably 0.5 to 2% by weight of an additive selected from the group consisting of cryolite, sodium borate, fluorite, and any desired mixtures of two or more of the above compounds; and iii) remainder to 100% being calcium oxide or of a mixture which contains more than 0% by weight of calcium oxide, but at most 99% by weight of calcium oxide, preferably at most 95% by weight of calcium oxide, in particular preferably at most 90% by weight of calcium oxide, particularly preferably at most 75% by weight of calcium oxide, and very particularly preferably at most 50% by weight of calcium oxide and a remainder to 100% being one or more compounds selected from the group consisting of calcium hydroxide, calcium carbonate, calcium carbide and any desired mixtures of two or more of the aforesaid compounds.

A further subject of the present invention is a method of manufacturing a previously described agent for desulfurizing, in particular for desulfurizing molten pig iron or molten steel, which comprises the following steps:

a) mixing of i) calcium oxide; bitumen; iii) optionally, at least one flux agent; iv) optionally, at least one further additive; as well as v) one or more calcium compounds selected from the group consisting of calcium hydroxide, calcium carbonate, calcium carbide and any desired mixtures of two or more of the aforesaid compounds; and b) grinding the mixture obtained in step a) to powder having a distribution of a range of grain sizes in which at least 80% by weight of the powder has a groin size of less than 32 μm, at least 85% by weight of the powder has a grain size of less than 45 μm; at least 90% by weight of the powder has a grain size of less than 63 μm, and at least 95% by weight of the powder has a grain size of less than 90 μm. The starting materials, i.e. i) calcium oxide; ii) optionally bitumen; iii) at least one flux agent; iv) optionally, at least one further additive as well as v) one or more calcium compounds selected from the group consisting of calcium hydroxide, calcium carbonate, calcium carbide and any desired mixtures of two or more of the above compounds having a grain size of in each case a maximum of 20 mm are preferably added and then mixed with one another in the method step a).

It is proposed in a further development of the idea of the invention to grind the mixture obtained in method step a) to powder having a grinding fineness of 90 R 5 in method step b) and preferably to powder having a distribution of a range of grain sizes in which at least 80% by weight of the powder has a grain size of less than 32 μm, at least 85% by weight of the powder has a grain size of less than 45 μm, at least 90% by weight of the powder has a grain size of less than 63 μm, and at least 95% by weight of the powder has a grain size of less than 90 μm.

For the comminution of the mixture manufactured in method step a) in method step b), all apparatus familiar to the skilled person can be used with which corresponding mixtures can be comminuted. Non-restrictive examples for these are granulators, impact mills and hammer mills.

Provided that the desulfurization agent to be manufactured is additionally intended to contain magnesium and/or a magnesium alloy, it is preferred not to admix it and/or them in method step a), but rather to admix it and/or them to the already ground mixture after the method step b). The reason for this is that, as presented above, at least the calcium oxide contained in the desulfurization agent is to be ground to a comparatively small grain size, namely to one having a distribution of a range of grain sizes at which at least 80% by weight of the calcium oxide has a grain size of less than 32 μm. Such a small grain size is, however, not advantageous for the magnesium or the magnesium alloy optionally contained in the desulfurization agent because this would produce an explosive atmosphere on grinding. It is therefore proposed in accordance with a preferred embodiment of the present invention only to admix the optional magnesium and/or the optional magnesium alloy after method step b), and indeed as particulate magnesium and/or particulate magnesium alloy, with at least 99% of all particles having a diameter of at least 30 μm, preferably of at least 30 to 200 μm and particularly preferably from 50 to 200 μm.

A mixture is preferably manufactured by the method which consists of i) 0.1 to 20% by weight of bitumen, preferably 1 to 10% by weight of bitumen, particularly preferably 2 to 6% by weight of bitumen, and very particularly preferably 2 to 4% by weight of bitumen;

ii) 0.01 to 10% by weight of a flux agent, preferably 0.05 to 0.2% by weight of a flux agent, very particularly preferably 0.075 to 0.125% by weight of a flux agent and most preferably approximately 0.1% by weight of a flux agent selected from the group consisting of multivalent alcohols, bituminous coals and silicone oils and any desired mixtures thereof, preferably selected from the group consisting of glycols, organopolysiloxanes and any desired mixtures thereof and particularly preferably of a polymethylhydrogensiloxane;

iii) 0 to 15% by weight of magnesium and/or of a magnesium alloy, preferably 1 to 15% by weight of magnesium and/or of a magnesium alloy, and particularly preferably 6 to 12% by weight of magnesium and/or of a magnesium alloy;

iv) 0 to 10% by weight of an additive, preferably 0.5 to 8% by weight of an additive, particularly preferably of 0.5 to 4% by weight of an additive, and particularly preferably 0.5 to 2% by weight of an additive selected from the group consisting of cryolite, sodium borate, fluorite and any desired mixtures of two or more of the above compounds; and iv) the remainder to 100% being calcium oxide or of a mixture which contains at least 20% by weight of calcium oxide, preferably at least 50% by weight of calcium oxide, in particular preferably al least 75% by weight of calcium oxide, particularly preferably at least 90% by weight of calcium oxide, very particularly preferably at least 95% by weight of calcium oxide, and most preferably at least 99% by weight of calcium oxide and the remainder to 100% by weight being one or more compounds selected from the group consisting of calcium hydroxide, calcium carbonate, calcium carbide and any desired mixtures of two or more of the above-named compounds.

The present invention finally relates to the use of the previously described agent for desulfurizing and/or pre-desulfurizing and/or for the slag treatment of molten pig iron or molten steel.

The agent for desulfurization is preferably introduced into the molten pig iron or into the molten steel by an immersion lance process using a transport gas, preferably argon or nitrogen, or by a stirring-in process, and indeed preferably in an amount of 2 to 5 kg per tonne molten pig iron or molten steel.

In particular when the agent is used for pre-desulfurization and/or for the slag treatment of molten pig iron or molten steel, it is particularly preferred to provide the agent in the form of one or more briquelles and to add them to the molten pig iron or molten steel.

The present invention will be further described in the following with reference to these examples, which illustrate the present invention, but which are, however, not restrictive.

EXAMPLE

A mixture was manufactured by mixing:

93.9% by weight of calcium oxide;

6% by weight hard bitumen; and 0.1% by weight silicone oil (flux agent).

This mixture was mixed homogeneously in a mixer and ground to a powder having a distribution of a range of grain sizes in which 84.30% by weight of the powder has a grain size of less than 32 μm, 87.9% by weight of the powder has a grain size of less than 45 μm, 90.1% by weight of the powder has a grain size of less than 63 μm, and at least 95.12% by weight of the powder has a grain size of less than 90 μm.

The desulfurization agent thus obtained was injected into an amount of 1.1 kg/t pig iron by an immersion lance process in multiinjection with respect to the mixture involved containing lime and bitumen. In this respect, at pig iron temperatures around 1300° C. with unchanging injection amounts of the other substances involved in the multiinjection, 350 ppm sulfur was removed from the molten pig iron.

Pig iron having a sulfur content of 26 ppm on average was obtained.

Comparison Example

A desulfurization agent was manufactured as described in the example, with the exception that it does not contain any bitumen.

A mixture was rather manufactured by mixing:

97.9% by weight technical calcium carbide;

2.0% by weight cryolite (additive); and 0.1% by weight silicone oil (flux agent).

This mixture was ground as described in the example and was introduced into molten pig iron by an immersion lance process in multiinjection while taking account of the same technological conditions at the same plane with 1.1 kg/t pig iron.

Pig iron having a sulfur content of 25 ppm was obtained.

The invention claimed is:

1. A method for desulfurizing comprising the step of adding a desulfurization agent to a melt of at least one of a molten pig iron and a molten steel, said agent containing calcium oxide, bitumen as well as between 0.01 and 10% by weight of at least one flux agent, wherein the at least one flux agent is selected from the group of members consisting of multivalent alcohols, bituminous coal, silicone oils and mixtures thereof, and wherein the agent does not contain any calcium carbide, any magnesium or any magnesium alloy.

2. A method in accordance with claim 1, wherein said desulfurization agent is introduced into the molten pig iron or into the molten steel by an immersion lance process using a transport gas or by a stirring-in process.

3. A method in accordance with claim 1, wherein said desulfurization agent is provided in the form of one or more briquettes and is added into the molten pig iron or into the molten steel for pre-sulfurizing and/or for the slag treatment of molten pig iron or of molten steel.

4. A method for desulfurizing comprising the steps of obtaining a smelt of one of molten pig iron and molten steel; and introducing a desulfurization agent into said smelt composed of calcium oxide or a mixture which contains at least 20% by weight of calcium oxide and one or more compounds selected from the group consisting of calcium hydroxide, calcium carbonate, and any desired mixtures of the aforesaid compounds;

1 to 10% by weight bitumen;

0.01 to 10% by weight of a flux agent to increase the flow behavior of said calcium oxide, said flux agent being selected from the group consisting of multivalent alcohols, bituminous coals, silicone oils, glycols, organopolysiloxanes, any desired mixtures thereof; and up to 10% by weight of an additive selected from the group consisting of cryolite, sodium borate, fluorite, and any desired mixtures thereof.

5. A method for desulfurizing comprising the steps of obtaining a smelt of one of molten pig iron and molten steel; and introducing a desulfurization agent into said smelt composed of calcium oxide or a mixture which contains at least 20% by weight of calcium oxide and one or more compounds selected from the group consisting of calcium hydroxide, calcium carbonate, and any desired mixtures of the aforesaid compounds;

2 to 6% by weight bitumen;

0.01 to 10% by weight of a flux agent to increase the flow behavior of said calcium oxide, said flux agent being selected from the group consisting of multivalent alcohols, bituminous coals, silicone oils, glycols, organopolysiloxanes, any desired mixtures thereof; and up to 10% by weight of an additive selected from the group consisting of cryolite, sodium borate, fluorite, and any desired mixtures thereof.

6. The method of claim 5 wherein said desulfurization agent contains 80 to 99.9% by weight of calcium oxide.

7. The method of claim 6 wherein at least 80% by weight of the calcium oxide has a grain size of less than 32 μm.

8. The method of claim 6 wherein said desulfurization agent is in the form of at least one briquette of a size (length×width) viewed in cross-section of from 10×5 to 200×100 mm.

9. The method of claim 5 wherein the bitumen is selected from the group of members consisting of road construction bitumen, hard road construction bitumen, soft bitumen, modified bitumen, distillation bitumen, high-vacuum bitumen, polymer-modified bitumen, special bitumen, industrial bitumen, oxidation bitumen, hard bitumen, blended bitumen, cold bitumen, fluxed bitumen, flux bitumen, natural asphalt and any desired mixtures of two or more of the aforesaid compounds.

10. The method of claim 5 wherein said desulfurization agent contains between 0.05 and 0.5% by weight of said flux agent.

11. The method of claim 5 wherein the calcium oxide is soft burnt lime.

12. The method of claim 11 wherein said desulfurization agent contains between 0.05 and 0.5% by weight of said flux agent.

* * * * *